United States Patent [19]

Muenstermann

[11] 4,022,226

[45] May 10, 1977

[54] TENSION CURLER

[75] Inventor: Walter J. Muenstermann, Denver, Colo.

[73] Assignee: The Raymond Lee Organization, Inc., New York, N.Y. ; a part interest

[22] Filed: Jan. 9, 1976

[21] Appl. No.: 647,711

[52] U.S. Cl. ..... 132/39; 132/40
[51] Int. Cl.[2] ..... A45D 2/02
[58] Field of Search ..... 132/39, 40, 42, 43 A, 132/38 R

[56] References Cited

UNITED STATES PATENTS

| | | | |
|---|---|---|---|
| 2,166,386 | 7/1939 | Auster | 132/43 A |
| 3,232,300 | 2/1966 | Fisher | 132/39 |
| 3,326,222 | 6/1967 | Rosenheim | 132/40 |

*Primary Examiner*—G.E. McNeill
*Attorney, Agent, or Firm*—Daniel Jay Tick

[57] ABSTRACT

A tension curler for curling wet hair comprises a spring-like sheet of resilient material rolled to have overlapping end edges and forming a cylindrical member. The sheet has a central area intermediate its end edges of greater thickness than the remainder thereof.

2 Claims, 4 Drawing Figures

TENSION CURLER

BACKGROUND OF THE INVENTION

The present invention relates to a tension curler. More particularly, the invention relates to a tension curler for curling wet hair.

Objects of the invention are to provide a tension curler of simple structure, which is inexpensive in manufacture, used with facility and convenience, and functions efficiently, effectively and reliably to curl the wet hair of a user, proving great flexibility by contracting in application and expanding afterward for a tight curl and more durable set.

BRIEF DESCRIPTION OF THE DRAWINGS

In order that the invention may be readily carried into effect, it will now be described with reference to the accompanying drawing, wherein.

DETAILED DESCRIPTION OF THE INVENTION

Figure 1:
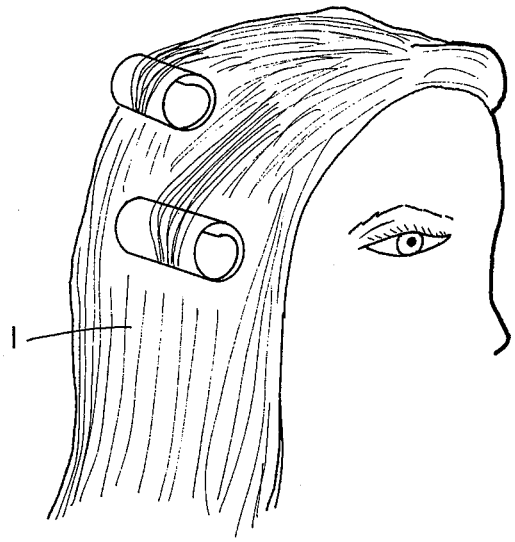
FIG. 1 is a perspective view of a pair of tension curlers of the invention in use.
Figure 4:
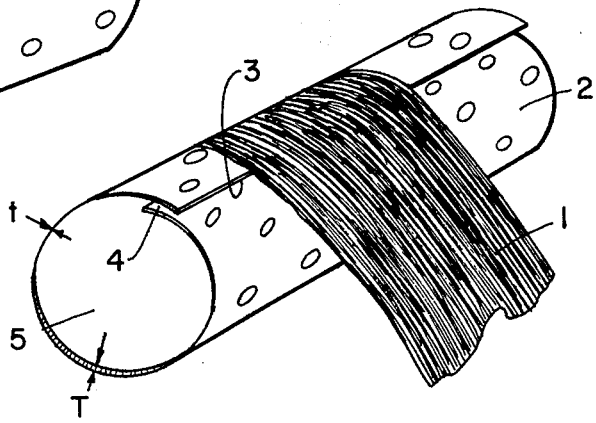
FIG. 4 is a perspective view of the tension curler of FIGS. 1 and 2 in use.

The tension curler of the invention is for curling wet hair 1 (FIGS. 1 and 4).

Figure 2:
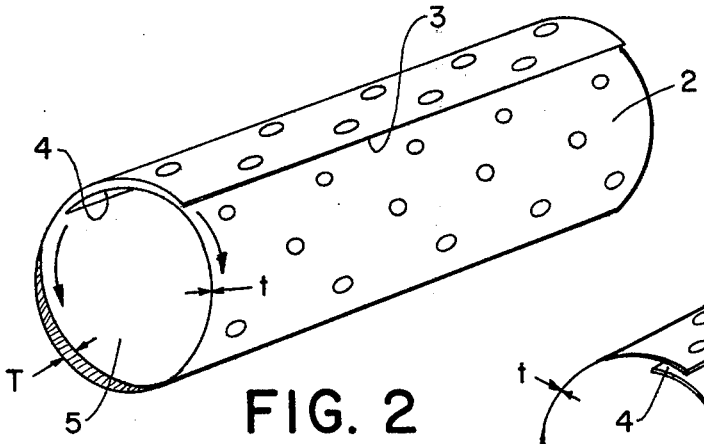
FIG. 2 is a perspective view of an embodiment of the tension curler of the invention as it is used.

The curler of the invention comprises a spring-like sheet 2 of resilient material such as, for example, plastic of any suitable type, rolled to have overlapping end edges 3 and 4 (FIGS. 2 to 4) and forming a substantially cylindrical member, as shown in FIGS. 1, 2 and 4.

Figure 3:
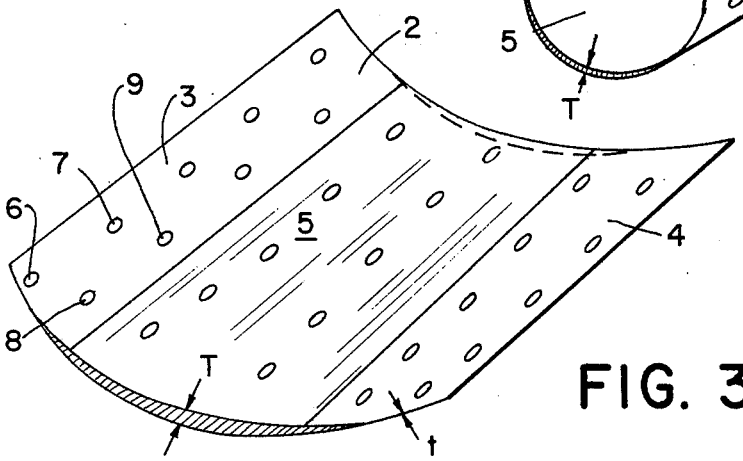
FIG. 3 is a developed view of the embodiment of FIG. 2.

The sheet 2 has a central area 5 intermediate its end edges 3 and 4 of greater thickness T than the thickness $t$ of the remainder thereof, as shown in FIGS. 2 to 4.

A plurality of spaced holes 6, 7, 8, 9, and so on (FIG. 3), are formed through the sheet 2 to expedite drying of wet hair 1 rolled therein.

While the invention has been described by means of a specific example and in a specific embodiment, I do not wish to be limited thereto, for obvious modifications will occur to those skilled in the art without departing from the spirit and scope of the invention.

I claim:

1. A tension curler for curling wet hair, said curler comprising a spring-like sheet of resilient material rolled to have free overlapping end edges and forming a substantially cylindrical member, said end edges being freely slidable relative to each other to vary the diameter of the cylindrical member during use of the tension curler, said sheet having a central area intermediate its end edges of greater thickness than the remainder thereof, said sheet comprising plastic and the hair of a user being wound around the outside of the cylindrical member for wet-setting and drying thereof, said cylindrical member contracting in application to wet hair and thereafter expanding for a tight curl and durable set.

2. A tension curler as claimed in claim 1, further comprising a plurality of spaced holes formed through the sheet to expedite drying of wet hair curled therein.

* * * * *